US009499303B2

(12) United States Patent
Glaser et al.

(10) Patent No.: US 9,499,303 B2
(45) Date of Patent: Nov. 22, 2016

(54) FINGERLOOP TOTE HANDLE, CONTAINER ASSEMBLY AND RELATED METHODS

(71) Applicant: Fisher Scientific Company L.L.C., Fair Lawn, NJ (US)

(72) Inventors: John T. Glaser, Clifton Park, NY (US); Jack A. Rodriguez, Bernardsville, NJ (US)

(73) Assignee: Fisher Scientific Company, L.L.C., Fair Lawn, NJ (US)

( * ) Notice: Subject to any disclaimer, the term of this patent is extended or adjusted under 35 U.S.C. 154(b) by 242 days.

(21) Appl. No.: 14/199,699

(22) Filed: Mar. 6, 2014

(65) Prior Publication Data

US 2015/0251811 A1 Sep. 10, 2015

(51) Int. Cl.
*B65D 23/10* (2006.01)

(52) U.S. Cl.
CPC ..... *B65D 23/104* (2013.01); *Y10T 29/49826* (2015.01)

(58) Field of Classification Search
CPC ..... B65D 23/104
USPC ..... 220/752, 759, 212.5, 318, 710.5, 755, 220/756, 758, 764, 769, 770, 771, 775, 776, 220/265, 319, 212; 215/274, 250, 901, 201, 215/387, 396; 206/217
See application file for complete search history.

(56) References Cited

U.S. PATENT DOCUMENTS

| | | | | |
|---|---|---|---|---|
| 5,806,904 | A | 9/1998 | Smith | |
| 6,394,517 | B1 | 5/2002 | Borg | |
| 7,481,325 | B2 | 1/2009 | Simpson, Jr. et al. | |
| D587,569 | S | 3/2009 | Eveleth | |
| D704,551 | S * | 5/2014 | Wycoff | D9/434 |
| 2006/0180567 | A1 | 8/2006 | Ott | |
| 2013/0008915 | A1 * | 1/2013 | Dorn | A45F 5/102 220/755 |
| 2014/0117033 | A1 * | 5/2014 | Robbins, III | B65D 23/10 220/810 |

* cited by examiner

*Primary Examiner* — Robert J Hicks
*Assistant Examiner* — Kareen Thomas
(74) *Attorney, Agent, or Firm* — Wood Herron & Evans LLP

(57) ABSTRACT

A fingerloop tote handle for a container includes a tote ring and a handle connected via a tether member for assisting a user in carrying the container. The container includes a first rib projecting outwardly therefrom. The tote ring engages the first rib of the container, and the handle has a top surface and an aperture extending therethrough, with the aperture being defined as a pair of opposing and connecting major arcs configured for receiving a pair of adjacent fingers of the user. The top surface has a beveled edge adjacent to and surrounding the aperture. The tether member extends between and connects the tote ring and the handle such that the tether member radially outwardly supports the handle relative to the container.

17 Claims, 6 Drawing Sheets

FINGERLOOP TOTE HANDLE, CONTAINER ASSEMBLY AND RELATED METHODS

TECHNICAL FIELD

The present invention relates generally to a fingerloop tote handle and, more particularly, to a fingerloop tote handle for carrying a container as a container assembly.

BACKGROUND

Container assemblies are well known for storing, preserving, transporting, and handling any variety of contents, such as liquid or solid particulate materials or other consumer or commercial goods. Traditional container assemblies include a container for retaining the materials and an opening through the container by which the materials are inserted and/or removed from the container. A cap is often provided with the container to removably cover the opening so that a user may access the materials and selectively remove the materials from the confines of the container. As such, the container and cap effectively store and preserve any contents therein. The cap may also include a tamper evident feature to indicate to the user whether or not the cap has been removed from the container in order to further ensure the preservation and integrity of the contents therein.

To aid in the transportation and handling of these containers, a container assembly may also include features to help the user manipulate the container during use. For example, a large, rectilinear container for a liquid chemical may be beneficial to transport and store onsite, but may be difficult for the user to lift or control while pouring during use. To this end, a handle may be formed into the container or affixed to the container to aid the user. However, a formed handle may reduce the useful volume of the container and increase the complexity of the container. The formed handle also tends to be relatively rigid and thus more difficult to manipulate when transferring materials from the container. Similarly, a traditional affixed handle may increase the complexity of assembly, while negatively impacting the aesthetic appeal of the overall container assembly.

There is a need, therefore, for improvements in container assemblies, and specifically, a need for a container, a tote handle, and a method of assembly that addresses present challenges and drawbacks such as those described above.

SUMMARY

The present invention overcomes the foregoing and other shortcomings and drawbacks of container assemblies heretofore known. While the invention will be described in connection with an exemplary embodiment, it will be understood that the invention is not limited to this embodiment. On the contrary, the invention includes all alternatives, modifications and equivalents as may be included within the spirit and scope of the present invention.

In accordance with the principles of the present invention, a fingerloop tote handle for use by a user to carry a container includes a tote ring, a handle, and a tether member. The tote ring is configured to receive a portion of the container and configured to engage a first rib of the container. The handle has a top surface and an aperture extending therethrough. The aperture is defined by a pair of opposing and connecting major arcs configured to receive a pair of adjacent fingers of the user. The top surface has a beveled edge adjacent to and surrounding the aperture. The tether member extends between and connects the tote ring to the handle and is configured to radially outwardly support the handle relative to the container when the tote ring engages the first rib of the container.

In further accordance with the principles of the present invention, a fingerloop tote handle for use by a user to carry a container includes a tote ring, a handle, and a tether member. The tote ring is configured to receive a portion of the container and configured to engage a first rib of the container. The handle has an inner end portion and an outer end portion and tapers so as to reduce in thickness from the outer end portion in a direction toward the inner end portion. The handle also defines an aperture configured to receive at least one finger of the user. The tether member extends between and connects the tote ring to the inner end portion of the handle and is configured to support the handle radially outwardly relative to the container.

In use, a container assembly is assembled having a container and a fingerloop tote handle including a tote ring and a handle connected via a tether member. The handle has a top surface and defines an aperture extending therethrough as a pair of opposing and connecting major arcs configured to receive a pair of adjacent fingers of the user. The top surface has a beveled edge adjacent to and surrounding the aperture. The container has a first rib projecting outwardly from the container. The method of assembly includes positioning the fingerloop tote handle relative to the container such that the tote ring is aligned with the container. The method also includes inserting a portion of the container through the tote ring. Furthermore, the method includes engaging the tote ring with the first rib projecting outwardly from the container so that the tether member supports the handle radially and outwardly relative to the container.

These and other objects and advantages of the invention will become more readily apparent during the following detailed description taken in conjunction with the drawings herein.

BRIEF DESCRIPTION OF THE DRAWINGS

The accompanying drawings, which are incorporated in and constitute a part of the specification, illustrate embodiments of the invention and, together with a general description of the invention given above, and the detailed description of the embodiments given below, serve to explain the principles of the invention.

DETAILED DESCRIPTION OF THE INVENTION

Figure 1:
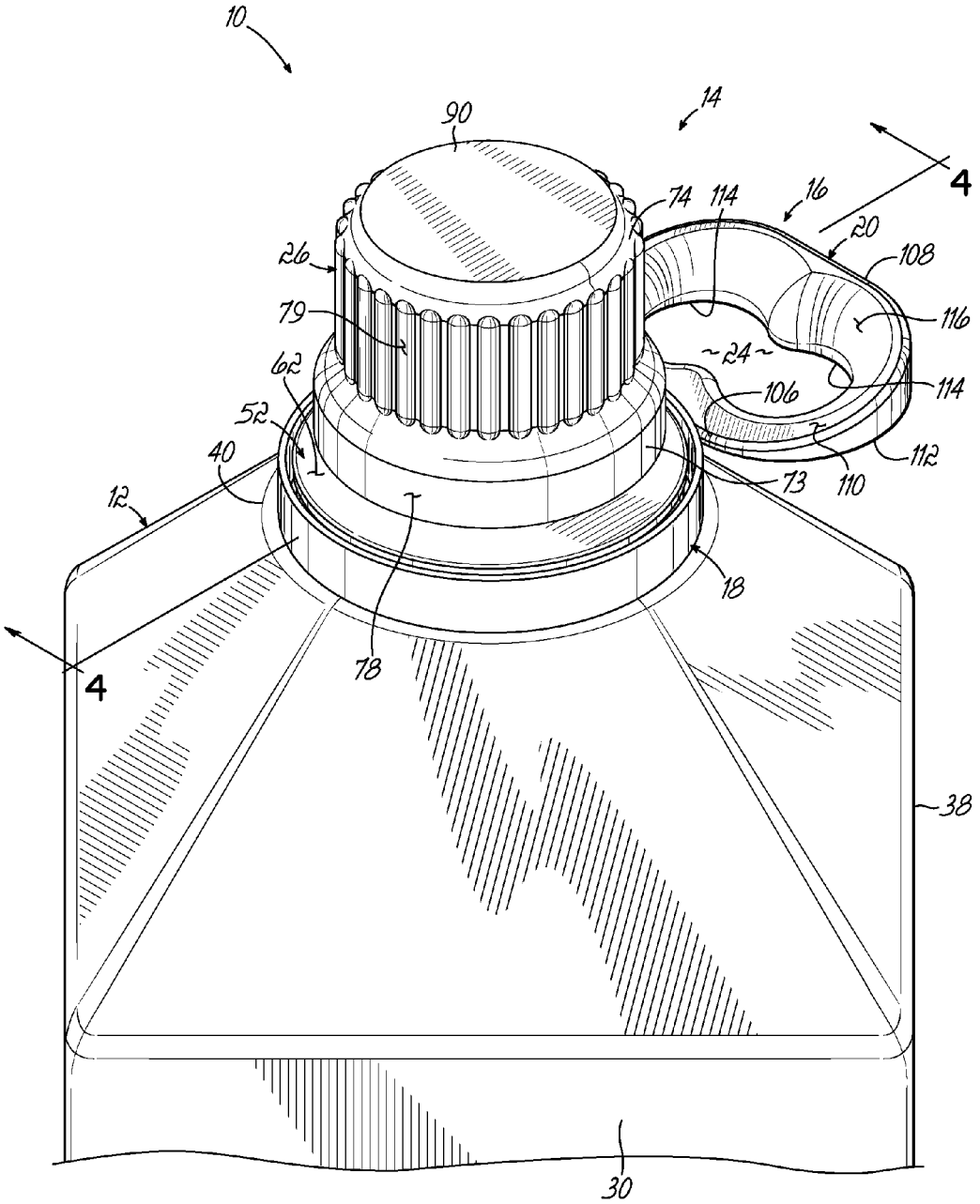
FIG. 1 is a perspective view of a container assembly including a closure assembly and a fingerloop tote handle secured to a container according to an exemplary embodiment of the invention.
Figure 2:
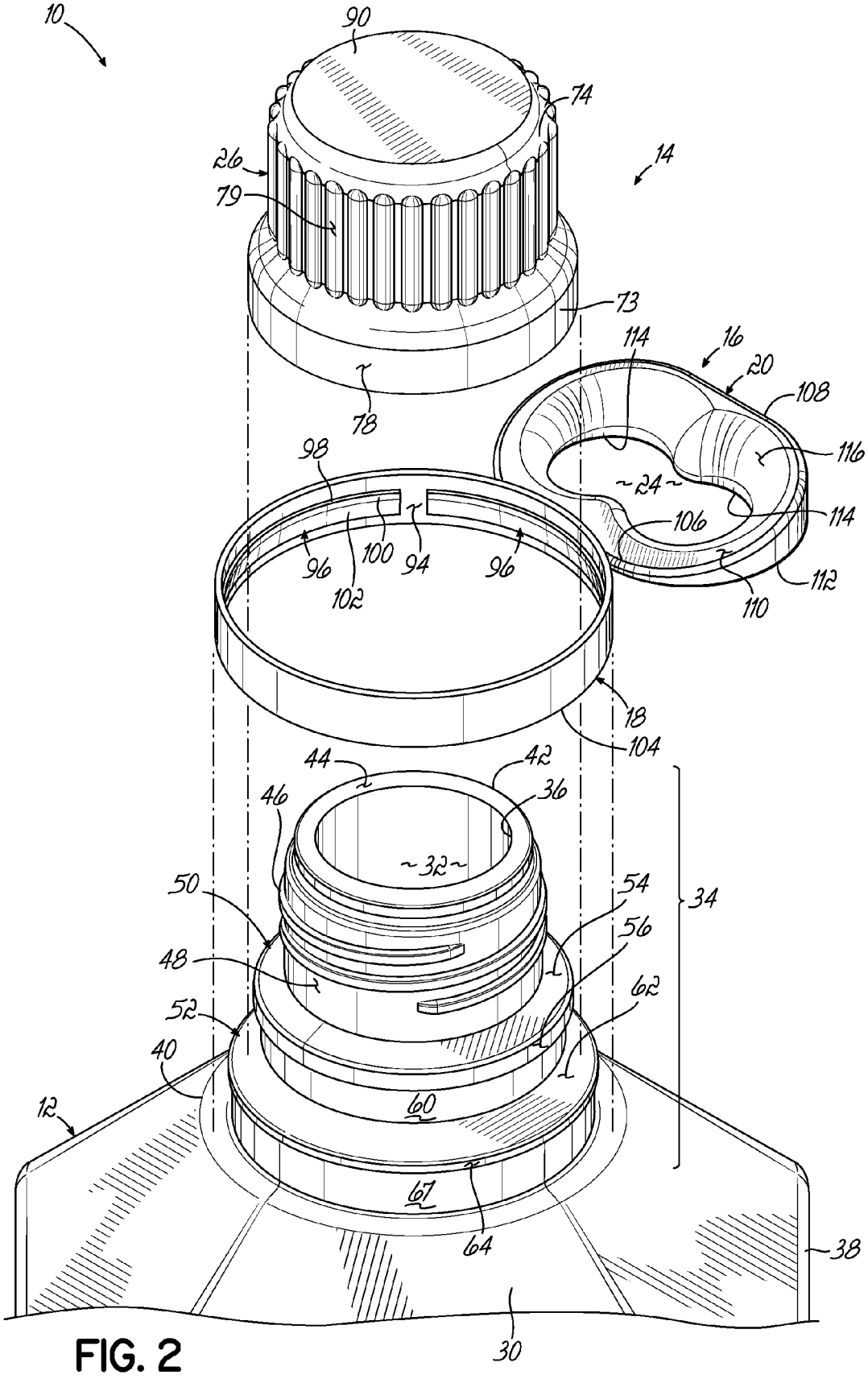
FIG. 2 is an exploded perspective view of the container assembly of FIG. 1.
Figure 3:
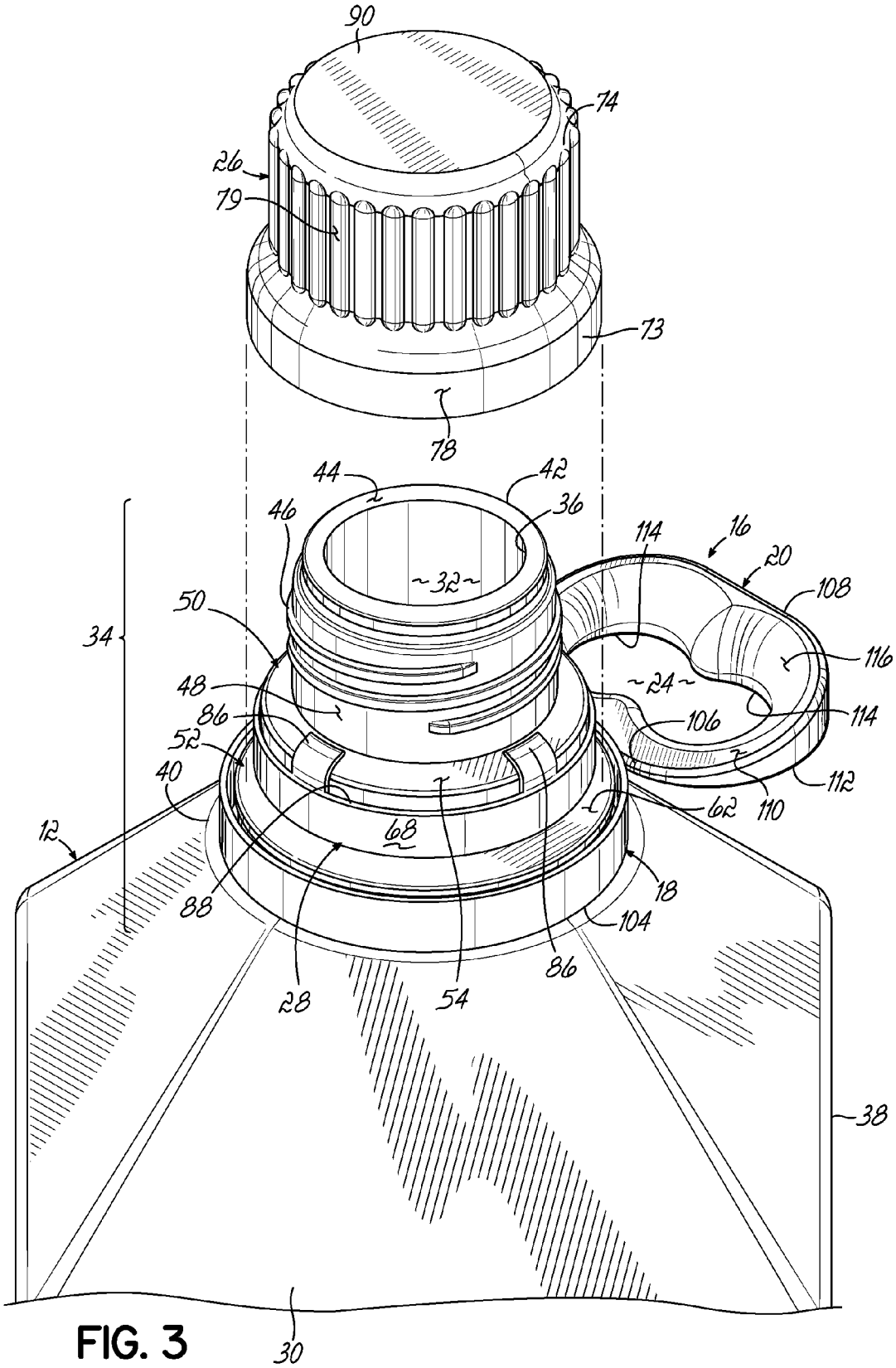
FIG. 3 is a view similar to FIG. 2 showing a cap removed from the container and a frangible tamper ring secured to the container.

With reference to FIG. 1 and FIG. 2, a first exemplary embodiment of a container assembly 10 in accordance with the invention is shown in detail. The container assembly 10 includes a container 12, a closure assembly 14, and a fingerloop tote handle 16 secured to the container 12. The fingerloop tote handle 16 generally includes a tote ring 18 connected to a handle 20 via a single, unitary tether member 22 (described with reference to FIG. 4 below). The handle 20 defines an aperture 24 extending therethrough for receiving at least one finger of a user such that the user may selectively carry the container 12 and, in turn, any contents therein. To secure the contents within the container 12, the closure assembly 14 includes a cap 26, which is configured to be selectively and removably secured to the container 12, and a tamper ring 28 (described with reference to FIG. 3 below). More particularly, the tamper ring 28 is configured to indicate to the user when the cap 26 has been initially removed from the container 12 and, as such, is a tamper-evidencing feature for ensuring the integrity of the contents within the container 12. It will be understood that the specific features of the closure assembly 14, such as the tamper ring 28, may be modified or omitted in other embodiments of the container assembly.

With further reference to FIG. 1 and FIG. 2, the container 12 generally includes a body 30 that defines an internal space 32 for holding contents, such as a liquid or solid particulate material. The closure assembly 14 closes and seals the container 12 so as to confine the contents to the internal space 32 and prevent leakage of contents. The body 30 includes a neck 34 that defines an opening 36 in the container 12. The body 30 also includes a main body portion 38 that is larger than the neck 34, and a shoulder 40 that is positioned generally between the main body portion 38 and the neck 34.

The neck 34 includes a rim 42 at a location generally opposite the shoulder 40, and the rim 42 includes an upper rim surface 44. The neck 34 also includes a threaded portion 46 below the rim 42. The threaded portion 46 is on an exterior surface 48 of the neck 34 and is configured for threadably securing the cap 26 to the neck 34. The neck 34 also includes a tamper rib 50 projecting outwardly from the exterior surface 48 for securing the tamper ring 28 (as described below) and a tote rib 52 projecting outwardly from the exterior surface 48 for securing the tote ring 18. According to an exemplary embodiment, both the tamper and tote ribs 50, 52 are located below the threaded portion 46 and, more particularly, the tote rib 52 is located below the tamper rib 50. It will be appreciated, however, that the tamper and tote ribs 50, 52 may be positioned elsewhere on the container 12 for securing the tamper and tote rings 28, 18 thereto. For example, the tamper and tote ribs 50, 52 may alternatively be in the form of a shoulder or lip defined by a groove circumscribing any portion of the container 12.

Figures 4, 4A:
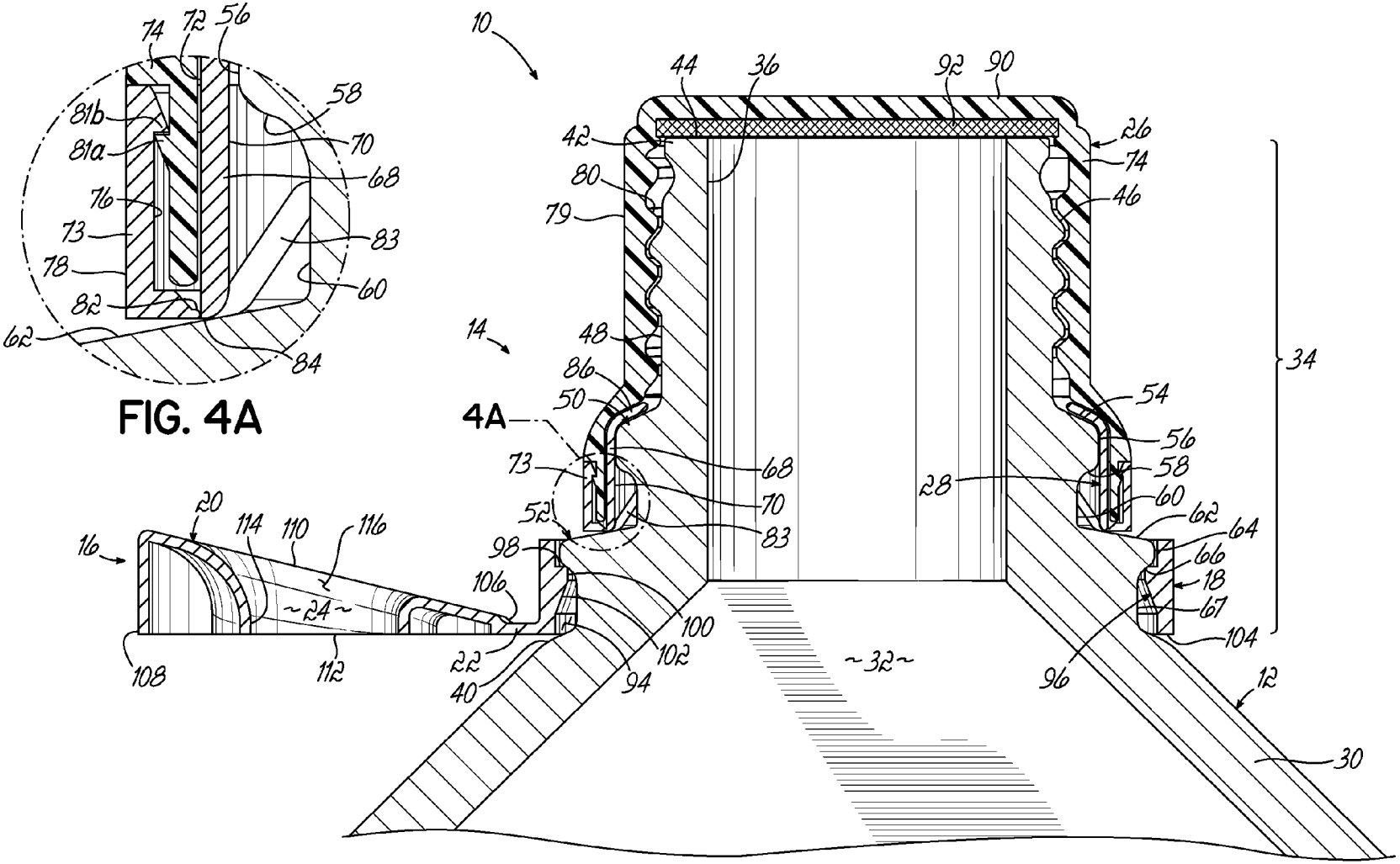
FIG. 4 is cross-sectional view of the container assembly taken along section line 4-4 of FIG. 1.
FIG. 4A is an enlarged portion of the cross-sectional view of FIG. 4, showing details of a frangible connection between the tamper ring and the cap.

As shown in FIG. 4, the tamper rib 50 extends radially outward from and around the circumference of the neck 34, and includes an upper surface 54 that slopes downwardly and away from the threaded portion 46 of the neck 34. A side surface 56 of the tamper rib 50 extends generally vertically and downwardly from the end of the upper surface 54. The tamper rib 50 further includes an underside 58 opposite the upper surface 54 and extending between the side surface 56 and the exterior surface 48 of the neck 34. An upper annular channel 60 is defined on the exterior surface 48 of the neck 34 between the tamper rib 50 and the tote rib 52.

The tote rib 52 extends radially outward from and around the circumference of the neck 34, and includes an upper surface 62 that extends away from the upper annular channel 60. A side surface 64 of the tote rib 52 extends generally vertically and downwardly from the end of the upper surface 62. The tote rib 52 further includes an underside 66 that extends between the side surface 64 and the remainder of the neck 34 that extends to the shoulder 40. A lower annular channel 67 is defined on the exterior surface 48 of the neck 34 between the tote rib 52 and the shoulder 40. According to an exemplary embodiment, the tote rib 52 defines a lower diameter and the tamper rib 50 defines an upper diameter such that the lower diameter is larger than the upper diameter.

Generally, the tamper ring 28, the cap 26, and the tote ring 18 each receive at least a portion of the neck 34 such that the opening 36 of the container 12 is securely closed or sealed (in the state shown in FIG. 1 and FIG. 4) to confine the contents held within the internal space 32. To this end, with reference to FIGS. 3 through 4A, the tamper ring 28 receives the neck 34 through a generally ring-shaped body 68 having an interior surface 70 that faces the exterior surface 48 of the neck 34 when the tamper ring 28 is secured with the neck 34. The body 68 also includes an exterior surface 72 that faces away from the interior surface 70 and away from the neck 34 when the tamper ring 28 is secured with the neck 34.

The cap 26 is configured for securing with the threaded portion 46 of the neck 34 and covering the opening 36 (FIGS. 1 and 4). The cap 26 includes an annular band 73 projecting downward from a generally cup-shaped body 74, which is configured to fit onto the threaded portion 46 of the neck 34. The annular band 73 includes an interior surface 76 that faces the exterior surface 72 of the tamper ring 28 when the cap 26 is secured to the neck 34 and the opening 36 is closed or sealed. The annular band 73 also includes an exterior surface 78 that faces away from the interior surface 76 and away from the tamper ring 28 when the cap 26 is secured to the neck 34. In the embodiment shown, an outer surface 79 of the body 74 is contoured (FIGS. 1 and 2) to allow a user to easily grip and manipulate the body 74, although the specific grip contours may be adjusted or omitted in other embodiments.

The body 74 also includes a threaded portion 80 therein that is complementary to the threaded portion 46 on the exterior surface 48 of the neck 48. Thereby, the body 74 of the cap 26 can be secured with the neck 34 by threading the threaded portions 80, 46 together, such as by rotating the body 74 relative to the neck 34. According to an exemplary embodiment, the annular band 73 directly connects to the body 74 via a plurality of cooperating clips 81*a*, 81*b*. At least one clip 81*a* projects from the body 74 toward the annular band 73 and at least one clip 81*b* projects from annular band 73 toward the body 74. As such, the respective clips 81*a*, 81*b* are configured to cooperatively snap together to connect the body 74 to the annular band 73.

As described above, the tamper ring 28 is associated with the cap 26 and configured to provide an indication when the cap 26 has been initially removed from the neck 34. As shown in FIG. 4, the tamper ring 28 is frangibly connected with the annular band 73 and is retained by the tamper rib 50 when the cap 26 is removed from the neck 34 in the state shown in FIG. 3. According to the features of the exemplary embodiment shown in greater detail in FIG. 4A, the frangible connection between the tamper ring 28 to the annular band 73 is provided by a plurality of slender webs 82 that connect the body 68 of the tamper ring 28 and the annular band 73. The frangible connection between the tamper ring 28 and the annular band 73 is configured to be broken when the body 74 and the annular band 73 are at least partially removed a first time from the neck 34. Therefore, the frangible connection may sever when the opening 36 is initially unsealed. In any case, when the frangible connection is broken at the slender webs 82, it is visually evident that the cap 26 has been removed at least once from the container 12.

To secure the tamper ring 28 to the tamper rib 50, the interior surface 70 of the body 68 includes a plurality of radially inwardly extending lower fingers 83 that engage the underside 58 of the tamper rib 50. More particularly with respect to FIG. 4 and FIG. 4A, the body 68 includes a lower edge 84, and the lower fingers 83 extend upwardly and inwardly from the lower edge 84 toward the underside 58 of the tamper rib 50. According to an exemplary embodiment, the body 68 also includes a plurality of radially inwardly extending upper fingers 86 that engage the upper surface 54 of the tamper rib 50. The body 68 includes an upper edge 88, as shown and described with respect to FIG. 3, and the upper fingers 86 extend upwardly and inwardly from the upper edge 88 toward the upper surface 54 of the tamper rib 50. More specifically, in the illustrated embodiment, the lower fingers 83 extend generally in a planar manner to occlude against the underside 58 at a point-like contact and the upper fingers 86 are curved along the length thereof to follow the contour of the side surface 56 and then the upper surface 54. As such, the lower and upper fingers 83, 86 engage the tamper rib 50 to position the tamper ring 28 about the upper annular channel 60.

The cap 26 includes a closed top end 90 at a terminal end of the body 74 that covers the opening 36 when the cap 26 is secured to the neck 34. According to an exemplary embodiment, the cap 26 further includes a seal member 92 sandwiched between the closed top end 90 and the upper rim surface 44 when the cap 26 is secured to the neck 34. The seal member 92 assists in forming a sealed closure of the container 12 for confining the contents contained therein to the internal space 32. It will be understood that the seal member 92 may be adhered to or otherwise retained within the cap 26 adjacent to the closed top end 90.

Figure 5:
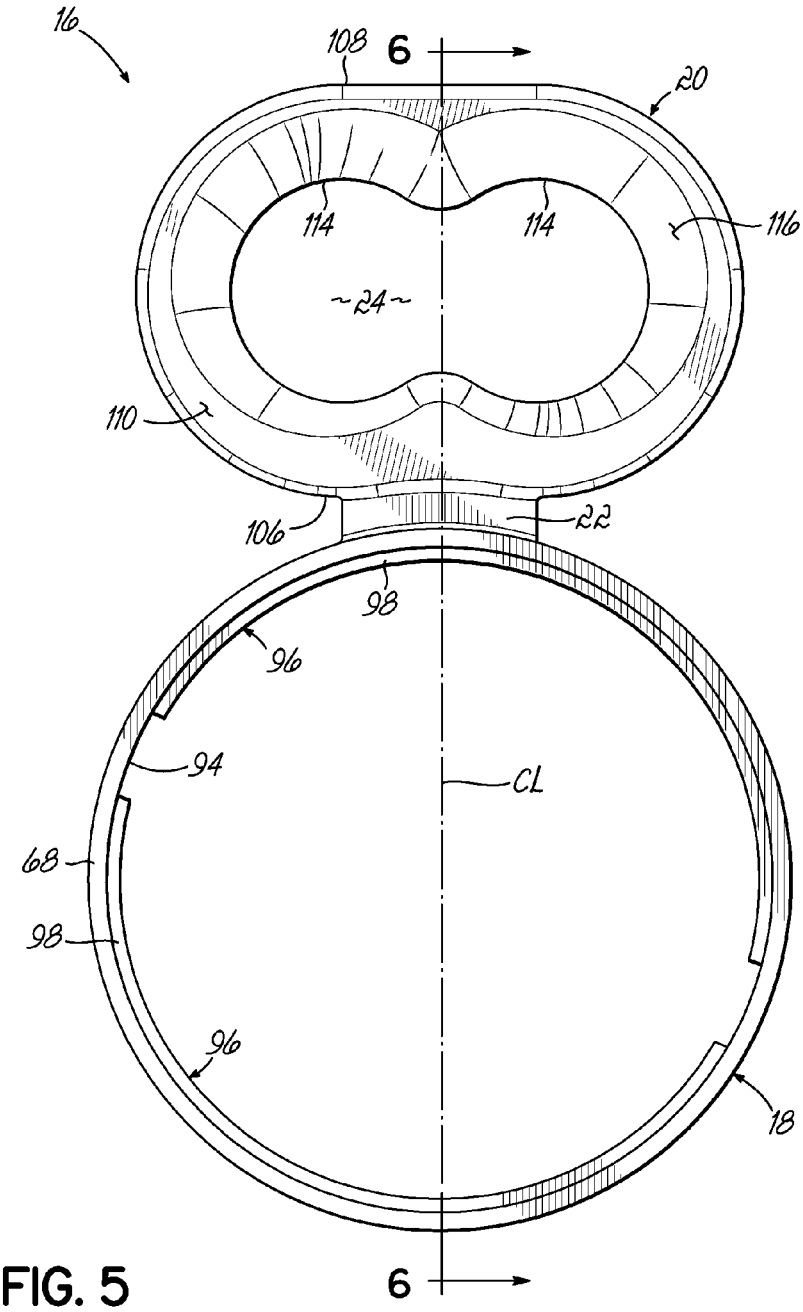
FIG. 5 is a top view of the fingerloop tote handle shown in FIG. 1.
Figure 6:
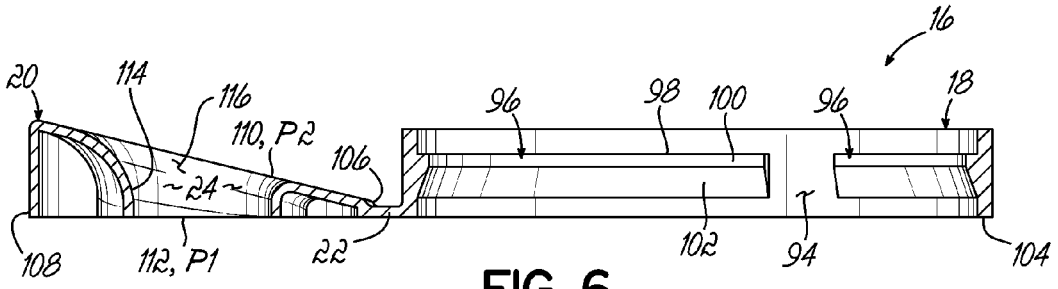
FIG. 6 is a cross-sectional view of the fingerloop tote handle taken along section line 6-6 of FIG. 5.

As described briefly above, the fingerloop tote handle 16 shown in FIGS. 4 through 6 includes the tote ring 18 connected to the handle 20 via the tether member 22 and, according to an exemplary embodiment, a single, unitary tether member 22. More particularly, the tote ring 18 includes an inner surface 94 having a lip 96 projecting inwardly and circumscribing at least a portion of the inner surface 94. According to the exemplary embodiment, the inner surface 94 has pair of opposing lips 96 facing inwardly toward each other. Each lip 96 includes a planar upper surface 98, a side surface 100 extending downward from the upper surface 98, and a ramped surface 102 tapering outward and downward from the side surface 100 toward the inner surface 94.

From a lower end portion 104 of the tote ring 18, the tether member 22 outwardly supports the handle 20 from the container 12 to a predetermined position relative to the tote ring 108. In this regards, the tether member 22 radially projects from the lower end portion 104 of the tote ring 18 and is semi-rigid. In other words, the tether member 22 is rigid enough to cantilever the handle 20 from the tote ring 18, but flexible enough to bend when the user manipulates the handle 20 for carrying the container 12. To provide this semi-rigid feature, the tether member 22 is formed from a plastic material. However, the tether member 22 may also be formed from a butyl, rubber, fiberglass, or elastomer material.

The handle 20 includes an inner end portion 106 extending toward an outer end portion 108 and defines the aperture 24 for the user to grip the fingerloop tote handle 16. According to an exemplary embodiment, the handle 20 has a tapered profile defined by a top surface 110 and a bottom surface 112 extending from the inner end portion 106 to the outer end portion 108. More particularly, the bottom surface 112 defines a generally horizontal plane P1 and the top surface 110 defines a plane P2 that tapers generally linearly from the outer end portion 108 to the inner end portion 106. As such, at least a portion of the top surface 110 tapers to the inner end portion 106 toward the tether member 22, which connects to the inner end portion 106 of the handle 20. According to an exemplary embodiment, the entire top surface 110 tapers to the inner end portion 106. Consequently, the handle 20 defines a thickest portion at the outer end portion 108 and reduces in thickness in a direction toward the inner end portion 106, which is advantageously where the user's fingers will grip the handle 20 while moving the container 12 with the fingerloop tote handle 16.

As shown in FIG. 5 and FIG. 6, the handle 20 is generally hollow and defines the aperture 24 as a pair of opposing major arcs 114 transversely extending through the bottom surface 112. According to an exemplary embodiment, the major arcs 114 connect generally in the form of a "FIG. 8" and are sized for receiving a pair of adjacent fingers of the user. To improve user comfort while receiving the fingers, the top surface 110 includes a beveled edge 116 that adjacently surrounds the aperture 24, either completely or partially. However, it will be appreciated that the aperture 24 may be sized for receiving any portion of the user's hand for gripping and manipulating the handle 20. Furthermore, the aperture 24, the handle 20, the tether member 22, and the tote ring 18 are generally symmetrical about a longitudinal centerline CL of the fingerloop tote handle 16, which, according to an exemplary embodiment, also extends along section line 6-6. Accordingly, tensile force caused by the user carrying the container via the fingerloop tote handle 16 typically is applied in a direction along the centerline CL for distributing the force relatively evenly therethrough. The handle 20, the tether member 22, and the tote ring 18 are each formed together as a unitary structure as shown and described herein. For example, the handle 20, tether member 22, and the tote ring 18 may be molded together, such as injection molded, coextruded, or thermoformed. However, it will be appreciated that the handle 20, the tether member 22, and the tote ring 18 may alternatively be formed separately and connected together using a fastener or other known connecting structure.

In order to assemble the container assembly 10 having the closure assembly 14 and the fingerloop tote handle 16 shown in FIGS. 1 through 4A, the tamper ring 28 and the annular band 73 are connected together with the frangible plurality of webs 82 discussed above. The body 74 is then connected to the annular band 73 via the clips 81*a*, 81*b* to form the cap 26 and, in turn, the entire closure assembly 14. According to the first exemplary embodiment, the cap 26 is formed separate from the container 12 as shown in FIG. 2. To close or seal the opening 36, the cap 26 is then threaded onto the threaded portion 46 of the neck 34 until the plurality of lower fingers 83 resiliently bend outward and over the tamper rib 50. The cap 26 is threaded downward until the plurality of lower fingers 83 bias against the neck 34 within the upper channel 60 against the tamper rib 50. In turn the upper fingers 86 engage the tamper rib 50 and the upper rim surface 44 closes against the seal member 92. The tamper ring 28 is secured to the tamper rib 50 in this final assembled state and the frangible connection to the cap 26 will sever when the cap 26 is unthreaded from the neck 34.

As an alternative to the cap 26 being formed separately from the container 12, the frangibly connected annular band 73 and tamper ring 28 may be secured to the tamper rib 50 as discussed above. Then, once the tamper ring 28 is secured to the tamper rib 50, the body 74 of the cap 26 may be threaded on the neck 34 until the clips 81*a*, 81*b* engage to form the fully assembled cap 26 on the container 12.

In any case, the tote ring 18 may be secured to the tote rib 52 before or after a portion of the closure assembly 14 is connected to the container 12. The neck 34 is inserted through the tote ring 18 until the ramped surface 102 of the lip 96 engages the tote rib 52. The tote ring 18 is then forced over the tote rib 52 such that the ramped surface 102 directs the tote ring 18 to bias outwardly and slide over the tote rib 52. Once each lip 96 is positioned within the lower channel 67, the tote ring 18 resiliently returns inwardly to its original shape with the upper surface 98 of the lip 96 adjacent to the tote rib 52 and rests on the shoulder 40 of the container 12. During manipulation of the container 12, the user may lift and move the container 12 by the fingerloop tote handle 16 such that each lip 96 engages the tote rib 52. In addition, the fingerloop tote handle 16 may be free to rotate about the neck 34, at least when the container 12 is not lifted or supported by the fingerloop tote handle 16, such that the user may position the handle 20 radially about the neck 34 as desired.

Figure 7:
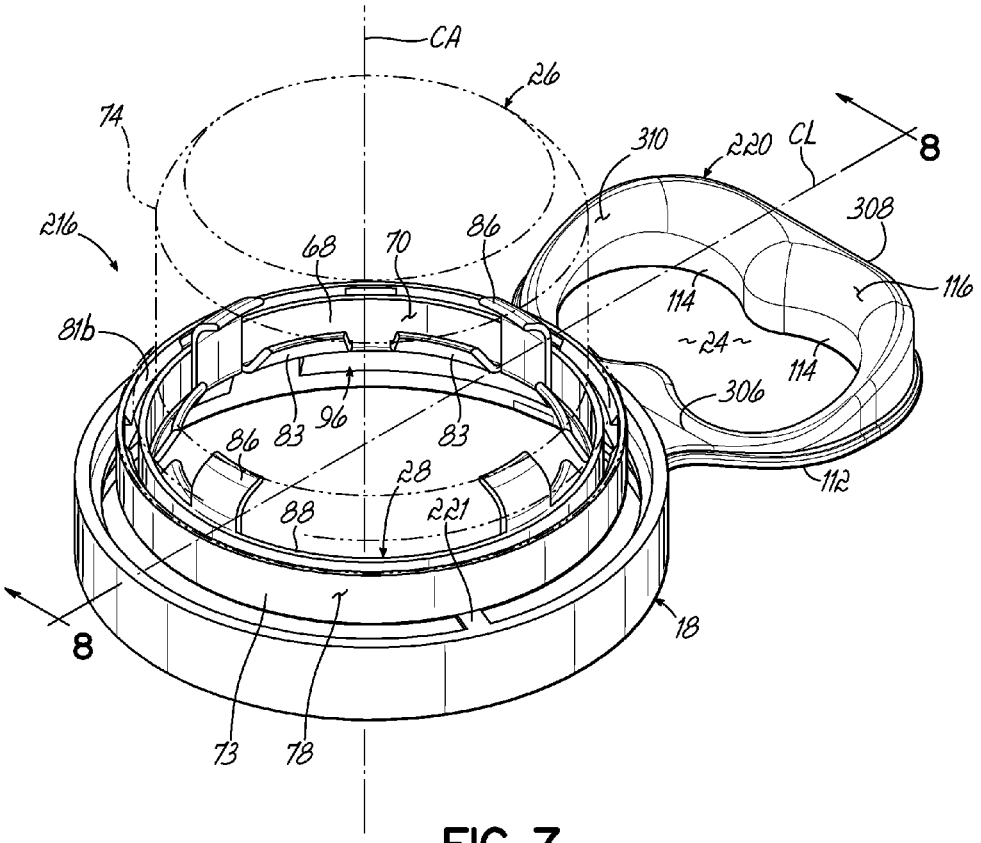
FIG. 7 is a perspective view of an alternative embodiment of a fingerloop tote handle having a cap and a tampering ring attached thereto.
Figure 8:
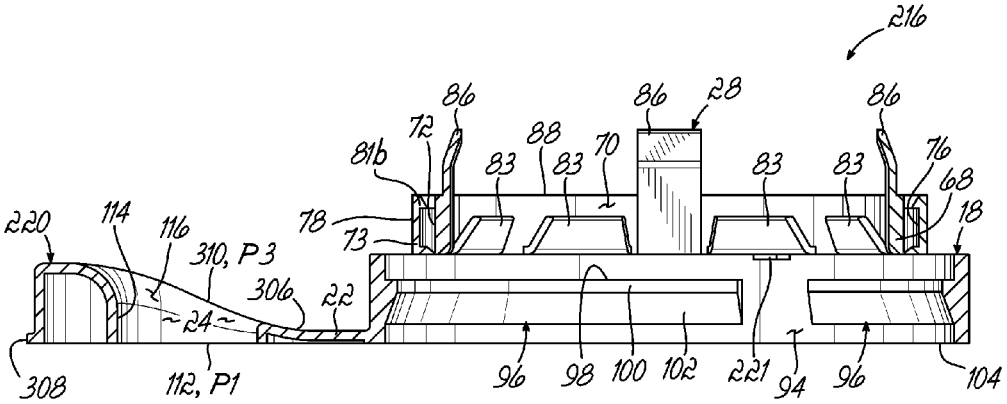
FIG. 8 is a cross-sectional view of the fingerloop tote handle taken along section line 8-8 of FIG. 7.

A second exemplary embodiment of a fingerloop tote handle 216 is shown in FIG. 7 and FIG. 8 for use with the container 12 and closure assembly 14 of FIGS. 1 through 4. The fingerloop tote handle 216 includes the tote ring 18, the unitary tether member 22, a handle 220, and the tamper ring 28 connected to the tote ring 18 via one or more connecting members 221. In this respect, like numbers indicate like features discussed above without repeated explanation below. The handle 220 includes an inner end portion 306 extending toward an outer end portion 308 and defines the aperture 24 for the user to grip the fingerloop tote handle 216. The handle 220 also has a tapered profile defined by a top surface 310 and the bottom surface 112 extending from the inner end portion 306 to the outer end portion 308. More particularly, the top surface 310 defines a plane P3 that tapers generally arcuately from the outer end portion 308 toward the inner end portion 306. Once again, the handle 220 defines a thickest portion at the outer end portion 308 and reduces in thickness in a direction toward the inner end portion 306, which is advantageously where the user's fingers will grip the handle 220 while moving the container 12 with the fingerloop tote handle 216.

According to an exemplary embodiment, a pair of the connecting members 221 extend between the tote ring 18 and the tamper ring 28 such that the fingerloop tote handle 216 is formed as a unitary structure. The fingerloop tote handle 216 also includes the annular band 73 frangibly connected to the tamper ring 28 as described above with reference to FIG. 4. As such, the annular band 73, the tote ring 18, and the tamper ring 28 each align along a common central axis CA shown in FIG. 7. This central axis CA is generally transverse and perpendicular to the centerline CL defining the symmetry along the length of the fingerloop tote handle 216. Moreover, because the body 74 of the cap 26 is also connected to the annular band 73, the body 74 similarly aligns with the common central axis. Thereby, during assembly, the annular band 73, the tote ring 18, the tamper ring 28, and the body 74 of the cap 26 are each assembled to the container 12 (see FIG. 1) generally simultaneously.

As an alternative to the body 74 of the cap 26 being positioned on the neck 34 generally simultaneously with tote ring 18, the tamper ring 28, and the annular band 73 during assembly, the tote ring 18, the tamper ring 28, and the annular band 73 may be respectively secured to the tote rib 52 and the tamper rib 50 simultaneously as discussed above prior. Then, once the tote and tamper ribs 52, 50 are secured thereto, the body 74 of the cap 26 may be threaded on the neck 34 until the clips 81*a*, 81*b* engage to form the cap 26 on the container 12.

While the present invention has been illustrated by a description of exemplary embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. A fingerloop tote handle for use by a user to carry a container including a first rib projecting outwardly from the container, comprising:

a tote ring configured to receive a portion of the container and engage the first rib of the container;

a handle having a top surface and an aperture extending therethrough, said aperture being defined by a pair of opposing and connecting major arcs configured to receive a pair of adjacent fingers of the user, and said top surface having a beveled edge adjacent to and surrounding said aperture; and a tether member extending between and connecting said tote ring to said handle such that said tether member supports said handle radially outwardly relative to the container, wherein said tether member is a single, unitary tether member extending between and connecting said tote ring to said handle, wherein said tote ring, said tether member, and said handle are each symmetrical about a common centerline oriented transverse to respective central axes of said tote ring and said aperture.

2. The fingerloop tote handle of claim 1, wherein said handle includes an inner end portion connected to said tether member and an outer end portion remote from said inner end portion, and said handle tapers so as to reduce in thickness generally linearly from said outer end portion in a direction toward said inner end portion.

3. The fingerloop tote handle of claim 1, wherein said handle includes an inner end portion connected to said tether member and an outer end portion remote from said inner end portion, and said handle tapers so as to reduce in thickness generally arcuately from said outer end portion in a direction toward said inner end portion.

4. The fingerloop tote handle of claim 1, wherein said tether member cantilevers said handle from said tote ring to a predetermined position relative to said tote ring.

5. A container assembly, comprising;

a container defining an opening and including a first rib projecting outwardly from said container; and said fingerloop tote handle according to claim 1, said fingerloop tote handle being selectively engaged with said container and configured to assist a user in carrying said container.

6. The container assembly of claim 5, wherein said tote ring includes an inner surface having a lip projecting radially inwardly therefrom, said lip being configured to engage said first rib and support said container when the user carries said container via said handle.

7. A container assembly, comprising;

a container defining an opening and including a first rib projecting outwardly from said container; and a fingerloop tote handle, said fingerloop tote handle being selectively engaged with said container and configured to assist a user in carrying said container, and said fingerloop tote handle further comprising:

a tote ring configured to receive a portion of the container and engage the first rib of the container;

a handle having a top surface and an aperture extending therethrough, said aperture being defined by a pair of opposing and connecting major arcs configured to receive a pair of adjacent fingers of the user, and said top surface having a beveled edge adjacent to and surrounding said aperture; and a tether member extending between and connecting said tote ring to said handle such that said tether member supports said handle radially outwardly relative to the container, wherein said tote ring includes an inner surface having a lip projecting radially inwardly therefrom, said lip being configured to engage said first rib and support said container when the user carries said container via said handle, wherein said container further includes a second rib axially offset from said first rib, and said fingerloop tote handle further comprises:

a tamper ring operatively connected to and axially offset from said tote ring; and a cap frangibly connected to said tamper ring, wherein said tamper ring is configured to engage said second rib and said cap is configured to removably engage said container to close and fluidly seal said container such that the frangible connection between said cap and said tamper ring is severed when said cap is first removed from said container and said tamper ring is retained by said second rib.

8. A fingerloop tote handle for use by a user to carry a container including a first rib projecting outwardly from the container, comprising:

a tote ring configured to receive a portion of the container and engage the first rib of the container;

a handle having an inner end portion and an outer end portion, said handle tapering so as to reduce in thickness from said outer end portion in a direction toward said inner end portion, said handle defining an aperture configured to receive at least one finger of the user, wherein said handle includes a bottom surface and a top surface each extending from said inner end portion to said outer end portion and facing opposite directions, said bottom surface being located along a horizontal plane in which said tote ring is also located, and said top surface being angled from the horizontal plane such that an entirety of said top surface tapers downwardly from said outer end portion to said inner end portion, thereby making an entirety of said handle taper in thickness between said outer end portion and said inner end portion; and a tether member extending between and connecting said tote ring to said inner end portion of said handle such that said tether member supports said handle radially outwardly relative to the container.

9. The fingerloop tote handle of claim 8, wherein said handle tapers so as to reduce in thickness generally linearly from said outer end portion in a direction toward said inner end portion.

10. The fingerloop tote handle of claim 8, wherein said handle tapers so as to reduce in thickness generally arcuately from said outer end portion in a direction toward said inner end portion.

11. The fingerloop tote handle of claim 8, wherein said tether member is a single, unitary tether member extending between and connecting said tote ring to said handle.

12. A container assembly, comprising;

a container defining an opening and including a first rib projecting outwardly from said container; and said fingerloop tote handle according to claim 8, said fingerloop tote handle being selectively engaged with said container and configured to assist a user in carrying said container.

13. The container assembly of claim 12, wherein said tote ring includes an inner surface having a lip projecting radially inwardly therefrom, said lip being configured to engage said first rib and support said container when the user carries said container via said handle.

14. A container assembly, comprising;

a container defining an opening and including a first rib projecting outwardly from said container, and a fingerloop tote handle, said fingerloop tote handle being selectively engaged with said container and configured to assist a user in carrying said container, and said fingerloop tote handle further comprising:

a tote ring configured to receive a portion of the container and engage the first rib of the container;

a handle having an inner end portion and an outer end portion, said handle tapering so as to reduce in thickness from said outer end portion in a direction toward said inner end portion, said handle defining an aperture configured to receive at least one finger of the user; and a tether member extending between and connecting said tote ring to said inner end portion of said handle such that said tether member supports said handle radially outwardly relative to the container, wherein said tote ring includes an inner surface having a lip projecting radially inwardly therefrom, said lip being configured to engage said first rib and support said container when the user carries said container via said handle, wherein said container further includes a second rib axially offset from said first rib, and said fingerloop tote handle further comprises:

a tamper ring operatively connected to and axially offset from said tote ring; and a cap frangibly connected to said tamper ring, wherein said tamper ring is configured to engage said second rib and said cap is configured to removably engage said container to close and fluidly seal said container such that the frangible connection between said cap and said tamper ring is severed when said cap is first removed from said container and said tamper ring is retained by said second rib.

15. A method of assembling a container and a fingerloop tote handle, the fingerloop tote handle including a tote ring and a handle connected via a tether member, the handle having a top surface and defining an aperture extending therethrough as a pair of opposing and connecting major arcs configured to receive a pair of adjacent fingers of a user, and the top surface having a beveled edge adjacent to and surrounding the aperture, and the container having a first rib projecting outwardly from the container, the method comprising:

positioning the fingerloop tote handle relative to the container such that the tote ring is aligned with the container;

inserting a portion of the container through the tote ring;

engaging the tote ring with the first rib projecting outwardly from the container so that the tether member supports the handle radially and outwardly relative to the container;

frangibly connecting a cap to a tamper ring;

engaging the cap with the container;

rotating the cap relative to the container;

engaging the tamper ring with a second rib extending outwardly from the container;

unsealing the cap by disengaging the cap from the container;

frangibly disconnecting the cap from the tamper ring; and retaining the tamper ring with the second rib.

16. The method of claim 15, wherein the tote ring includes an inner surface having a lip projecting radially inwardly therefrom, and the method further comprises:

inserting the lip of the tote ring over the first rib so as to engage the lip with the first rib such that the container is supported by the lip when a user carries the container.

17. The method of claim 15, wherein the tamper ring is operatively connected to the tote ring, and the method further comprises:

simultaneously engaging the tote ring and the tamper ring to the first rib and the second rib, respectively.

* * * * *